US007837576B1

(12) United States Patent
Paige

(10) Patent No.: US 7,837,576 B1
(45) Date of Patent: Nov. 23, 2010

(54) TWO-FACED GOLF PUTTER

(76) Inventor: David L Paige, 2779 Berwick Blvd., Columbus, OH (US) 43209

( * ) Notice: Subject to any disclaimer, the term of this patent is extended or adjusted under 35 U.S.C. 154(b) by 0 days.

(21) Appl. No.: 12/801,475

(22) Filed: Jun. 10, 2010

Related U.S. Application Data

(60) Provisional application No. 61/213,696, filed on Jul. 6, 2009.

(51) Int. Cl.
*A63B 69/36* (2006.01)
*A63B 53/04* (2006.01)

(52) U.S. Cl. ..... 473/242; 473/251; 473/252; 473/300; 473/325; 473/340

(58) Field of Classification Search ..... 473/219–256, 473/340–341, 300–304, 325, 328, 344; D21/736–746
See application file for complete search history.

(56) References Cited

U.S. PATENT DOCUMENTS

| | | | | | |
|---|---|---|---|---|---|
| 1,334,189 | A * | 3/1920 | Swanson | 473/306 |
| 3,333,854 | A * | 8/1967 | White | 473/288 |
| 3,989,256 | A * | 11/1976 | Cicero | 473/252 |
| 4,082,286 | A * | 4/1978 | La Breche | 473/241 |
| 4,343,472 | A * | 8/1982 | Hamilton | 473/240 |
| 4,508,350 | A * | 4/1985 | Duclos | 473/254 |
| 4,795,158 | A * | 1/1989 | Kuykendall | 473/201 |
| D312,858 | S * | 12/1990 | Anderson et al. | D21/746 |
| 5,275,412 | A * | 1/1994 | Innes | 473/253 |
| 5,383,664 | A * | 1/1995 | Epperson | 473/340 |
| 5,458,335 | A * | 10/1995 | Hattori | 473/325 |
| 5,564,990 | A * | 10/1996 | Weeks | 473/251 |
| 5,584,769 | A | 12/1996 | Sundin | |
| 5,690,556 | A | 11/1997 | Condon | |
| 6,045,453 | A | 4/2000 | Jenkins | |
| 6,340,336 | B1 * | 1/2002 | Loconte | 473/251 |
| 6,464,598 | B1 | 10/2002 | Miller | |
| 6,695,708 | B2 | 2/2004 | Fisher | |
| 6,699,139 | B2 * | 3/2004 | Kim | 473/242 |
| 6,767,292 | B1 * | 7/2004 | Skalla, Sr. | 473/251 |
| 7,018,304 | B2 | 3/2006 | Bradford | |
| 2004/0242342 | A1 | 12/2004 | Patten | |
| 2005/0227777 | A1 * | 10/2005 | Cover et al. | 473/251 |
| 2006/0063601 | A1 * | 3/2006 | Cameron | 473/252 |
| 2007/0004524 | A1 | 1/2007 | Harrison | |

* cited by examiner

*Primary Examiner*—Sebastiano Passaniti
(74) *Attorney, Agent, or Firm*—Richard C. Litman

(57) ABSTRACT

The two-faced golf putter includes a putter head having a putting face and a chipping face disposed on at least one side of the putter head, an angled toe, an angled heel and a bottom sole. Both the angled toe and heel include a respective setup guide to assist the user in properly positioning over the putter. A sight alignment groove is formed on the top of the putter head to help aim the ball. An elongated shaft extends upwardly from a centered bore in the top surface of the putter head, which improves balance and feel to the putter. The top portion of the shaft includes an elongated handle to accommodate a wide range of user grip sizes and techniques. To further assist accurate setup placement of the putter head, an alignment dot is disposed behind the shaft on top of the putter head. The bottom sole includes at least one upwardly extending sloping side to permit angling of the putter for chipping.

11 Claims, 5 Drawing Sheets

TWO-FACED GOLF PUTTER

CROSS-REFERENCE TO RELATED APPLICATION

This application claims the benefit of U.S. Provisional Patent Application Ser. No. 61/213,696, filed Jul. 6, 2009.

FIELD OF THE INVENTION

The present invention relates to golf clubs, more specifically, a two-faced golf putter for both putting and chipping a golf ball with improved accuracy and comfort.

DESCRIPTION OF THE RELATED ART

Golf is an old and popular game or sport enjoyed by many, whether it is on a recreational or competitive basis. One of the most fundamental aspects of the sport requires mastering the mechanics of the putt shot because one must exercise proper techniques in form, stroke and accuracy to hit the ball into the hole. The configuration of a putter goes a long way towards assisting the individual in practicing and improving his/her putt.

Even though there are a multitude of putter designs with variations ranging from the handle grip shape and length to the head shape, putters come in two basic varieties: a traditional blade head configuration and a relatively recent mallet head configuration. The traditional blade head putter is relatively thin and light. This putter is more accurate but less forgiving on off-center hits. The mallet head putter is wider and heavier, which gives the mallet head putter a larger MOI (moment of inertia). This helps to reduce twisting of the putter during the stroke and thereby reduce chances of off-center hits. The choice of which one to use depends on the strengths and weaknesses of the user in this aspect of the game, e.g., if the user's accuracy is sub par due to an undesirable twist in the stroke, then a mallet head putter may be an optimal club for that user. Current putters may also include a line on the putter head which functions as a visual aid for the user to aim their shot. However, this applies to the line of the shot without factoring in the toe to heel layout of the putter.

While the above play important roles for accurate putts, the comfort and convenience of the putter also has a significant impact. Golf is a highly individual sport in the sense that to perform well, equipment, i.e. golf clubs, should be tailored to the individual to maximize the required synergy between physical execution and mental concentration in applying the proper techniques. Individual players have unique physiques and endurances. Thus, the equipment should be comfortable enough to last at least eighteen holes. This ideal may not be realized by many casual enthusiasts due to costs of custom clubs. Moreover, left-handed golfers may not have an easy access to left-hand clubs compared to right-hand clubs.

Besides the putter, golf requires a plurality of other clubs that perform different functions during a round of golf, such as chippers, different weight irons, woods, and drivers. Costs can quickly increase, especially for custom clubs, so if a club is available to perform more than one function, it would be appealing to novices and professionals alike. Therefore, it would be a benefit in the art to provide a putter with dual functionality and convenience for a wide range of users.

Thus a two-faced golf putter solving the aforementioned problems is desired.

SUMMARY OF THE INVENTION

The two-faced golf putter includes a putter head having a putting face and a chipping face disposed on at least one side of the putter head, an angled toe, an angled heel and a bottom sole. Both the angled toe and heel include a respective setup guide to assist the user in properly positioning over the putter. A sight alignment groove is formed on the top of the putter head to help aim the ball. An elongated shaft extends upwardly from a centered bore in the top surface of the putter head, which improves balance and feel to the putter. The top portion of the shaft includes an elongated handle to accommodate a wide range of user grip sizes and techniques. To further assist accurate setup placement of the putter head, an alignment dot is disposed behind the shaft on top of the putter head. The bottom sole includes at least one upwardly extending sloping side to permit angling of the putter for chipping.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
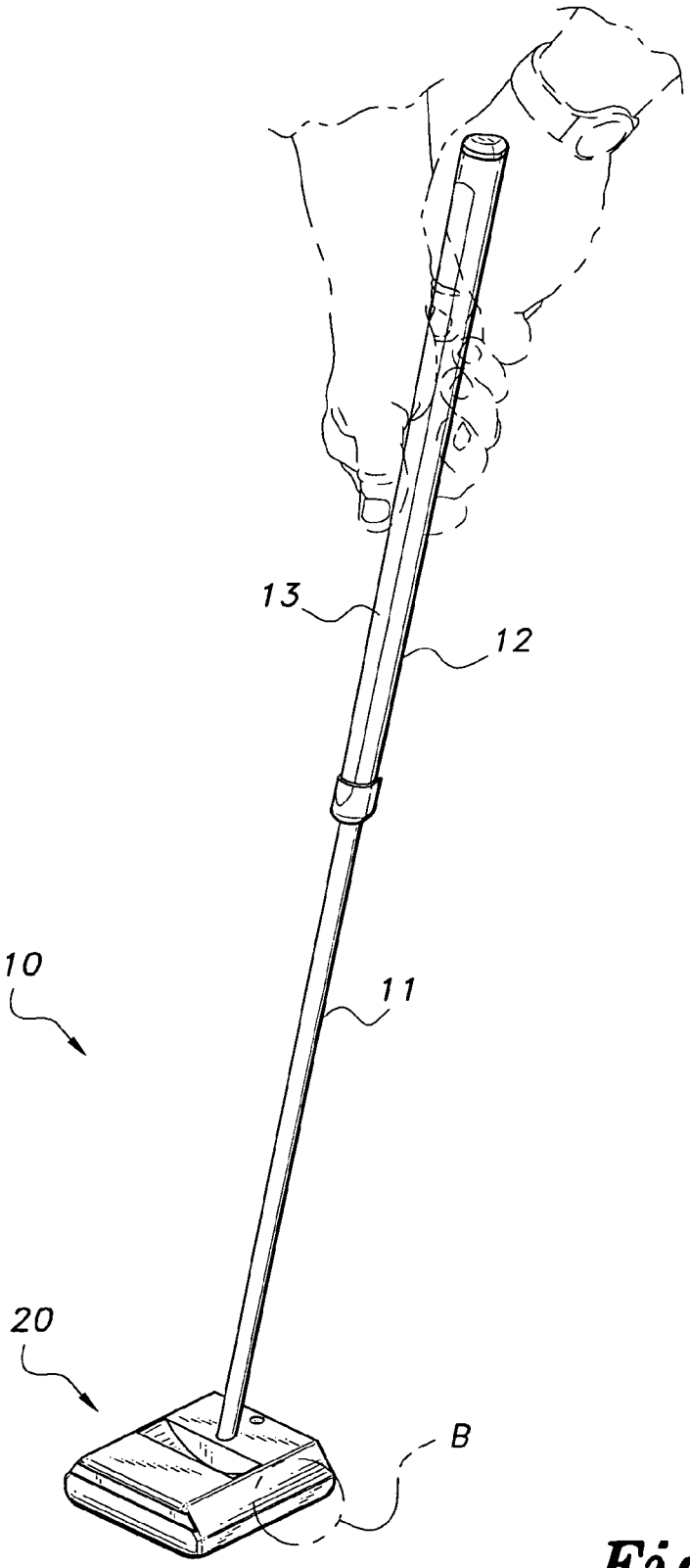
FIG. 1 is an environmental, perspective view of a two-faced golf putter according to the present invention.
Figure 2:
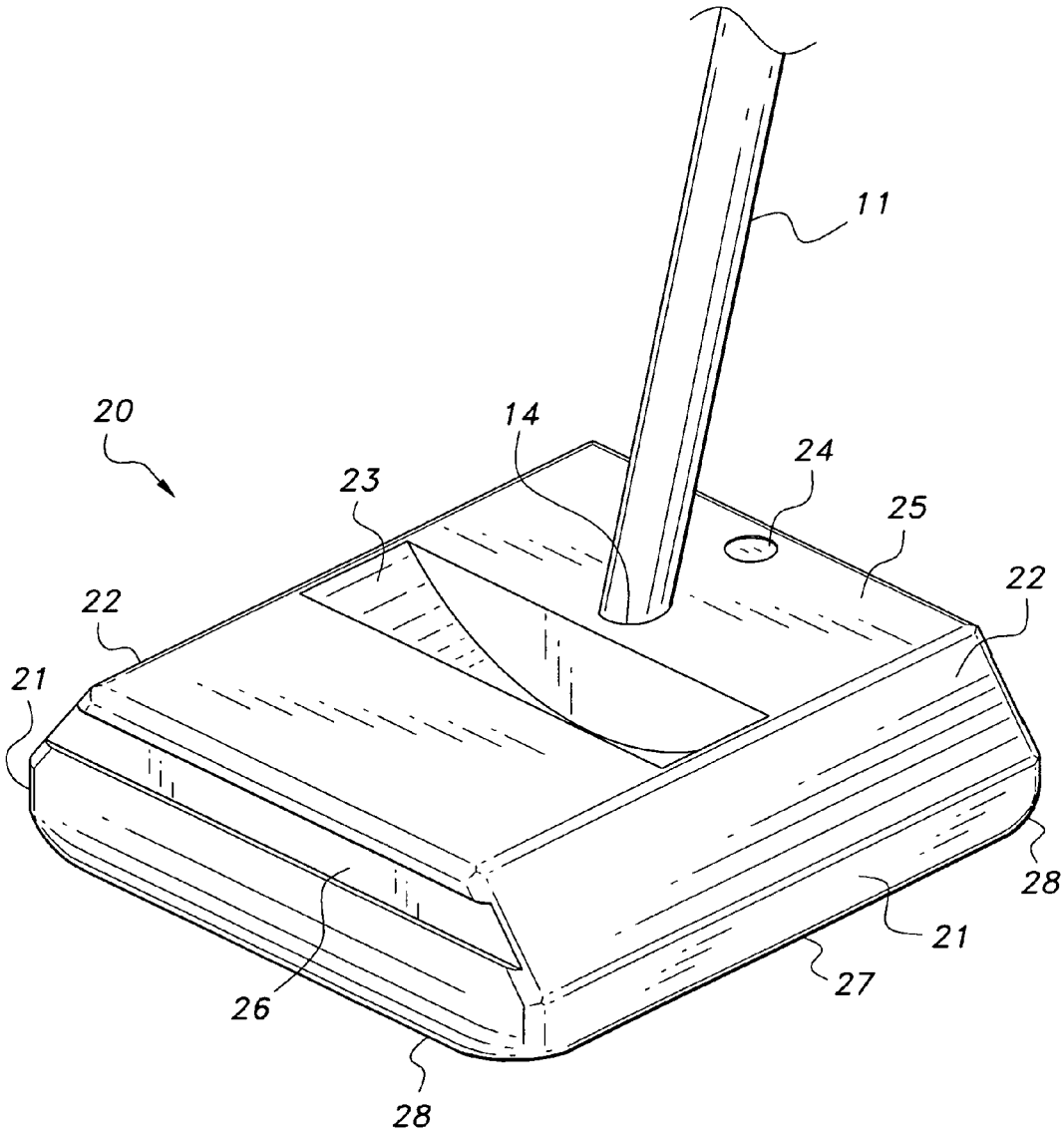
FIG. 2 is a partial perspective view of the two-faced golf putter according to the present invention, showing an enlarged view of the head.

The present invention relates to a two-faced golf putter, a first embodiment of which is generally referred to by reference number 10, for both putting and chipping shots, the putter 10 having features to accommodate a wide range of users and to assist setup and aim. As shown in FIGS. 1 and 2, the two-faced golf putter 10 includes a substantially square shaped putter head 20 attached to a shaft 11. The shaft 11 is attached to a centered bore 14 on the putter head 20, and the location thereof provides a better feel and balance to the overall putter 10. The bore 14 may be replaced by a hosel to facilitate installation of the shaft 11. The distal end of the shaft 11 includes an elongated handle 12. The handle 12 provides a wider grip than handles normally mounted on other clubs, such as drivers and irons, for a more comfortable grip on the two-faced golf putter 10. Since comfort can have a great impact on the user's accuracy, the handle configuration is just one of many ways the putter 10 strives to elevate the comfort level.

The grip 12 includes an elongate flat, planed alignment surface 13 extending parallel to the length of the grip 12. The flat, planed surface 13 is centered and aligned with the shaft 11 and the putter head 20 so that the two-faced putter 10 would be properly aligned with respect to the golfer's body when the handle 12 is grasped, due to the thumbs of the user automatically lining up in a typical grip. The handle 12 may be made from friction enhancing materials such as polystyrene, rubber, elastomeric tape or similar. The handle 12 may also include additional ergonomic features, such as an enlarged end for a uniform grip. Moreover, the handle 12 is preferably about seventeen inches long, which offers a wide range of grip surfaces for users of all heights.

Figure 3:
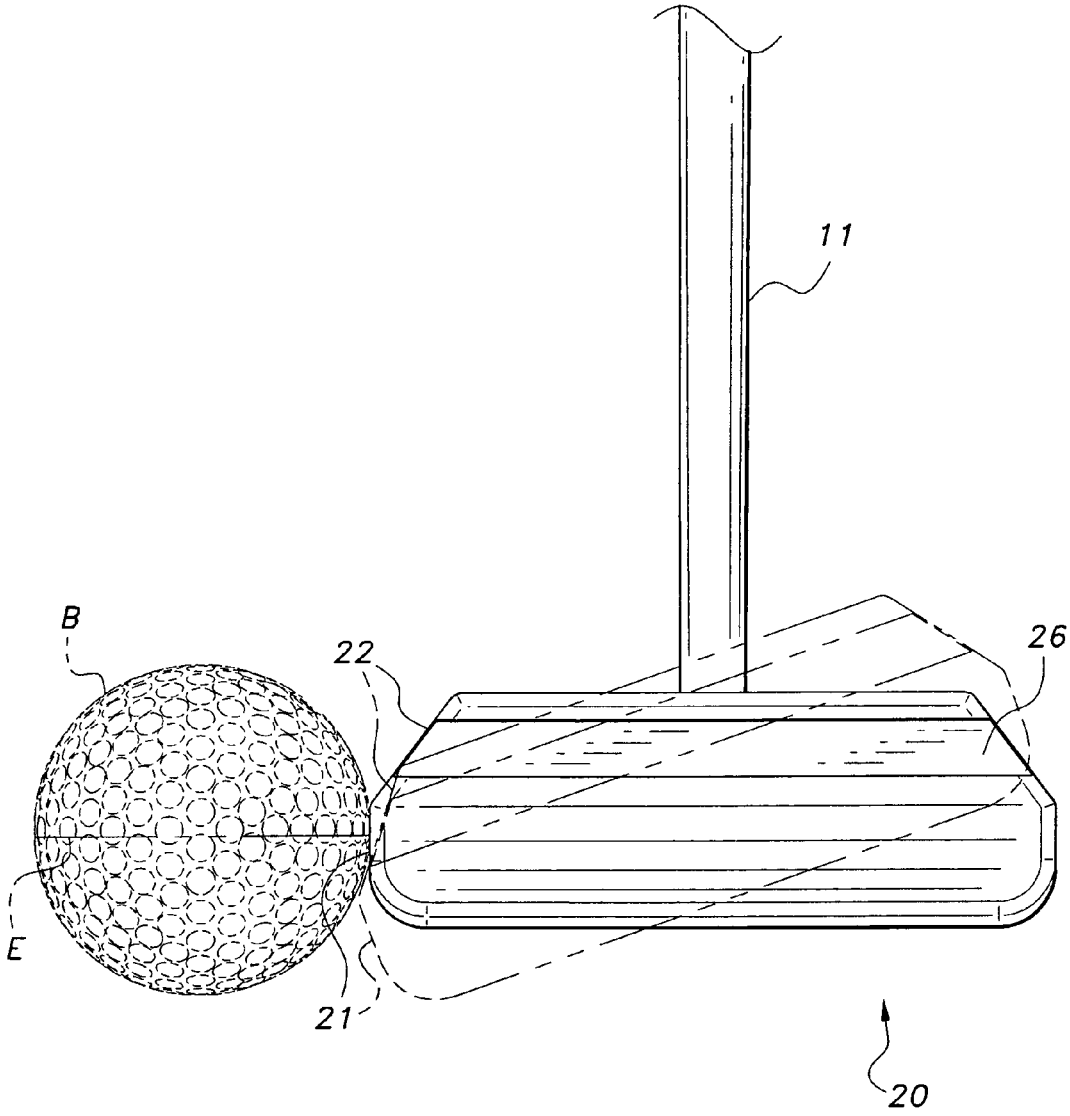
FIG. 3 is a partial environmental side view of the two-faced golf putter according to the present invention, illustrating the angle of the putting head when putting and when chipping the ball.

The putter head 20 includes two shot faces on lateral sides thereof; an angled or sloping surface defining a chip face 22 and a vertical surface defining a putter face 21. As shown in FIG. 3, the putter face 21 is adapted to engage the golf ball B near or at the centerline or equator of the ball B for a putt shot while the chip face 22 is adapted to engage the ball B below the equator E for a chip shot (the position of the putter head 20 shown in phantom). Since both faces 21, 22 are disposed on either side of the putter head 20, the two-faced golf putter 10 accommodates both right and left-hand users or golfers.

The putter head 20 includes a plurality of features to assist the user in setup and aim. One of these is a sight alignment groove 23 spanning the width of the putter head 20 and centrally disposed on the top surface of the putter head 20. The sight alignment groove 23 assists the golfer to aim the ball in the intended line of the shot. The sight alignment groove 23 may be a curved indention about ⅝ in. wide formed in the top surface of the putter head 20 via milling, but other shapes and processes may be used as long as the resulting groove facilitates aiming. Preferably, the sight alignment groove 23 is painted black to provide a clear visual cue, but other prominent colors are viable alternatives. Moreover, the painted sight alignment groove 23 may include a contrasting colored, thin stripe disposed along the centerline of the groove 23 for a more pronounced effect.

To make an accurate putt or chip shot, it is not enough to have the putter head 20 aimed at the intended shot line for the ball B. The putter head 20 must be properly situated or positioned to address the ball B. In that regard, the toe and heel of the putter head 20 include oppositely disposed sloping sides extending downwardly from the top, the sloping sides each having a setup guide 26. Each setup guide 26 may be a groove formed on the sloping face, the groove being painted in a noticeable color, such as red. The purpose of these setup guides 26 is to help prevent the golfer or user from improperly tilting the putter head 20 either towards the toe or towards the heel, i.e. ideally, the golfer should be directly over the two-faced putter 10 with the sole 27 of the putter head 20 substantially flat to the course surface. Otherwise, the resulting shot may cause the ball B to veer from the intended line.

If the two-faced golf putter 10 is improperly oriented, then the user will see one of the setup guides 26, which is an indication that adjustments must be made. As an additional measure, the putter head 20 also includes a setup dot 24 disposed behind the shaft 11. The setup dot 24 may be a circular indention or groove painted with a noticeable color, such as red. The setup dot 24 helps the golfer to square the putter head 20 with respect to the ball B. If the user is over the two-face golf putter 20 with the putter 20 properly set, then the user should not see any portion of the setup dot 24 as the user peers down the shaft 11. However, if any portion of the setup dot 24 can be seen on either side of the shaft 11, then it is an indication that repositioning of the two-faced golf putter 10 is necessary.

In addition to the features above for aiming and setup, the putter head 20 also includes a sole 27 with curved, upwardly sloping sides 28 on the toe and heel ends of the putter head 20. The sloping sides 28 allow for easy tilting of the putter head 20 for those instances where it is necessary. Moreover, the sloping sides 28 may be disposed toward the lateral sides of the putter head 20 to ease positioning of the two-faced golf putter 10 for chip shots.

Thus, it can be seen that the two-faced golf putter 10 accommodates a wide range of golfers or users and preferences. The sight alignment groove 23, the setup guides 26 and the setup dot 24 assist the user in properly addressing and aiming the shot, and the dual functioning shot faces eliminate the need for a separate chipper.

It is noted that the two-faced golf putter 10 encompasses a variety of alternatives. For example, the putter head 20 may be made from aluminum, plastic, wood, composites or other durable materials. The same applies to the shaft. Moreover, the two-faced golf putter 10 may also include an alternative putter head configuration that is not for both right and left hand use.

Figure 4:
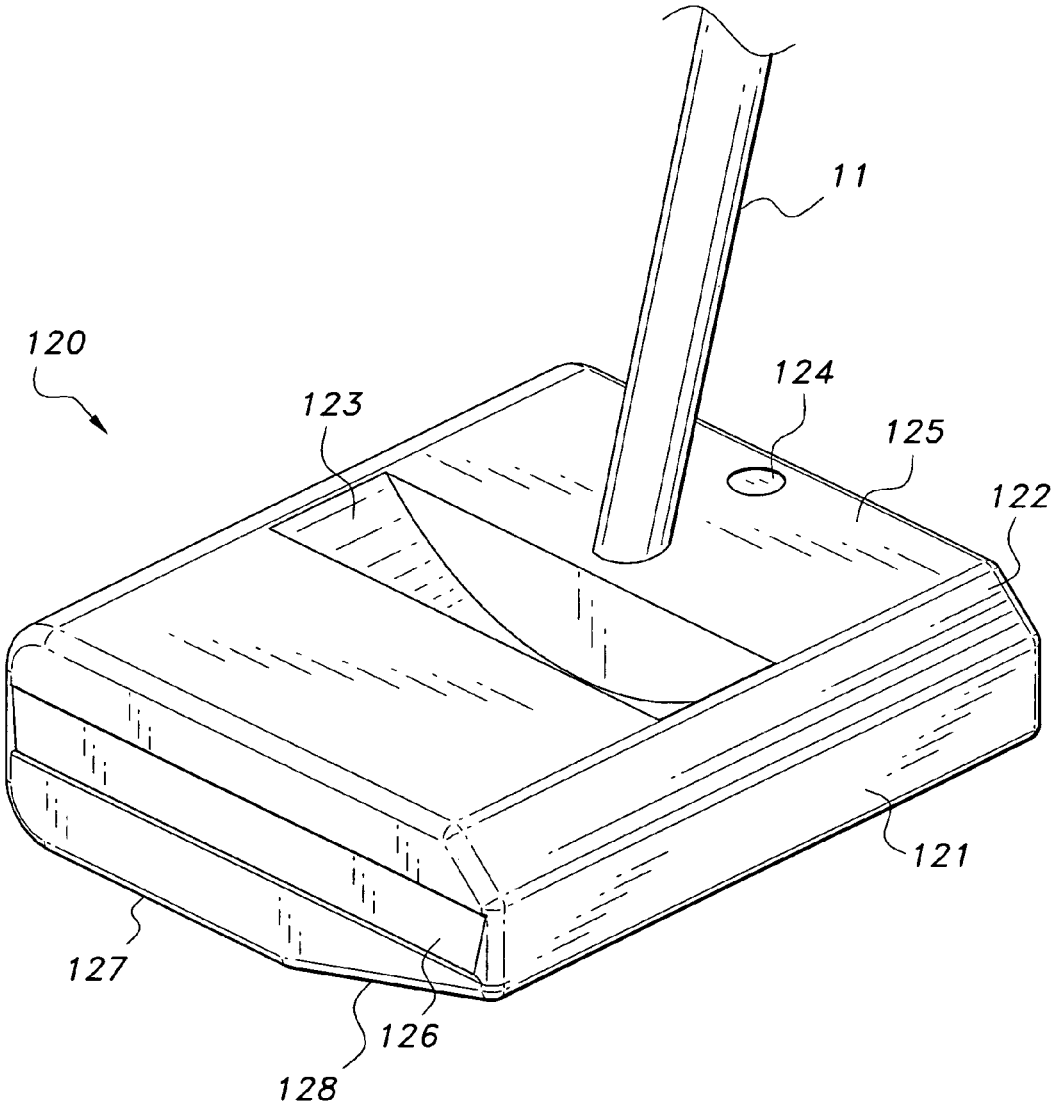
FIG. 4 is a partial perspective view of an alternative embodiment of a two-faced golf putter according to the present invention, showing a different configuration of the head.
Figure 5:
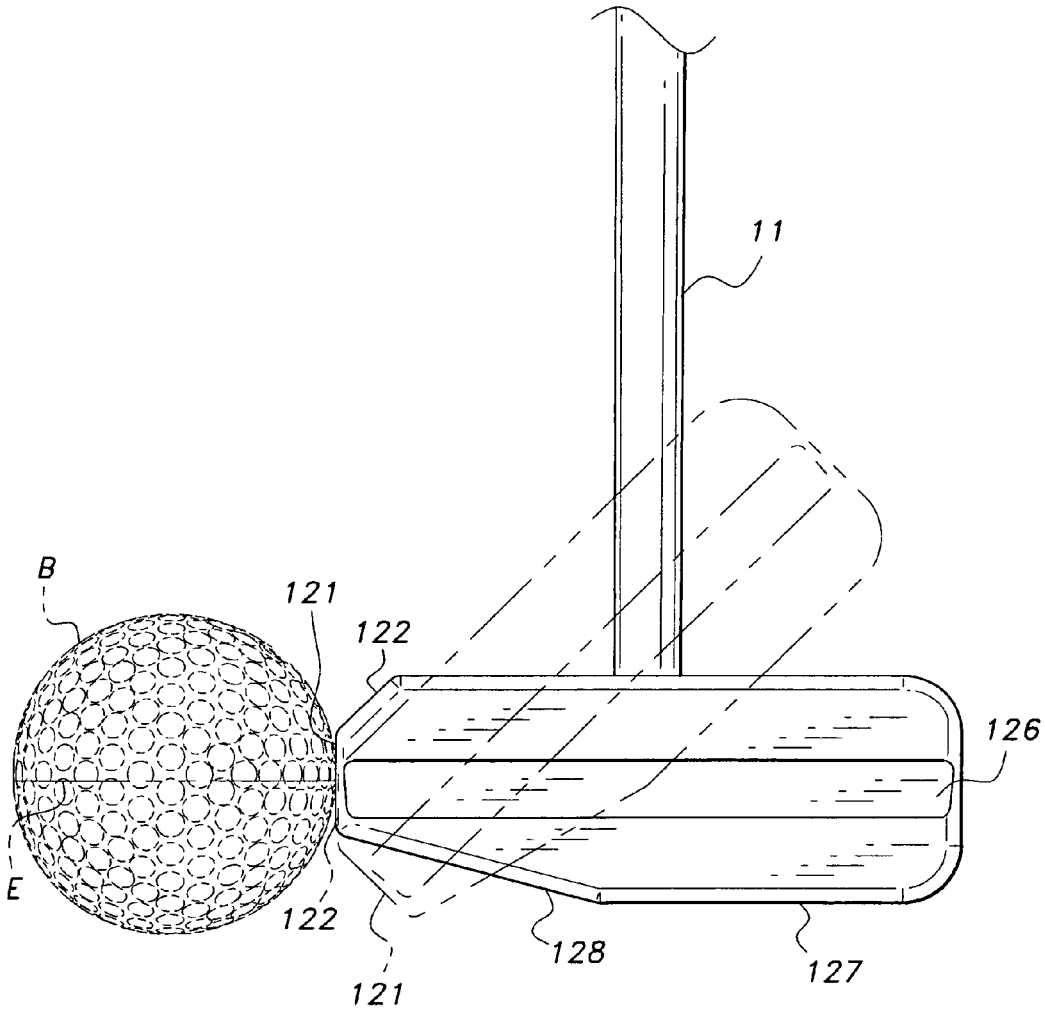
FIG. 5 is a partial environmental side view of the two-faced golf putter of FIG. 4, illustrating the angle of the putting head when putting and when chipping the ball.

In the example shown in FIGS. 4 and 5, the alternative putter head 120 is configured for a right-handed golfer. In this embodiment, the putter head 120 includes a sight alignment groove 123 and a setup dot 124 configured in a similar manner to the putter head 20 mentioned above. The setup guides 126 disposed on the toe and heel sides of the putter head 120 are defined by a groove that is flared or angled slightly away from the vertical plane of the toe and heel. These setup guides 126 are also painted in noticeable colors, and the angular disposition allows the user to see the setup guides 126 when improperly positioned. As with the previous putter head 20, the putter head 120 includes a vertical side defining a putting face 121 and a sloping side defining a chipping face 122, except that the two faces 121, 122 are only disposed on one lateral side of the putting head 120. The bottom sole 127 includes an upwardly sloping side 128 angled towards the two faces 121, 122. The sloping side 128 helps to position the putter head 120 either for a chip shot (shown in phantom in FIG. 5) or to position the putter face 121 slightly below the equator E in a situation where a slight chip may be necessary to get the ball B out of the grass. With the exception of the chip face 122 and putting face 121 being disposed on one side of the putting head 120, the resulting two-faced golf putter 10 functions in substantially the same manner as above.

It is to be understood that the present invention is not limited to the embodiments described above, but encompasses any and all embodiments within the scope of the following claims.

I claim:

1. A two-faced golf putter, comprising:

an elongated shaft having opposite ends;

an elongate handle disposed at one of the ends of the shaft; and a putter head attached to the opposite end of the shaft from the handle, the shaft being attached to the head at a centered location in a balanced manner, the putter head having;

a substantially square-shaped body having a top, a toe, a heel, a bottom sole and lateral sides, at least one of the lateral sides having both a sloping chipping face and a putting face defined thereon;

a sight alignment guide centrally disposed on the top of the body to assist aim;

a setup dot disposed on the head behind the shaft to visually warn a user when the body is not square with a golf ball; and a setup guide disposed on both the toe and heel of the body to visually assist the user in proper placement of the putter head;

wherein the chipping face and putting face permit alternately chipping and putting the ball.

2. The two-faced golf putter according to claim 1, further comprising an upwardly angled side disposed on the bottom sole to permit tilting of the putting head for a chip shot, the upwardly angled side extending towards said putting face.

3. The two-faced golf putter according to claim 1, wherein said handle comprises an elongate flat, planed alignment surface extending along the length of said handle, the alignment surface being centered and aligned with said shaft and said putter head to assist the user in lining up and properly gripping said handle.

4. The two-faced golf putter according to claim 1, further comprising both a sloping chipping face and a putting face disposed on the other of the lateral sides of said putting head.

5. The two-faced golf putter according to claim 1, wherein said sloping chipping face extends downwardly, at an angle, from the top of said body towards said putting face, said putting face being a vertical surface substantially normal to said bottom sole.

6. The two-faced golf putter according to claim 1, wherein said sight alignment guide comprises a curved indention centrally disposed on the top of said body, the curved indention spanning a substantial width of said body, the curved indention assisting aim by providing a visual line for squaring said putter head with respect to the golf ball.

7. The two-faced golf putter according to claim 6, wherein the curved indention is colored to emphasize the visual line.

8. The two-faced golf putter according to claim 1, wherein said setup guide comprises a channeled groove formed on the toe of said putter head and a channeled groove formed on the heel of said putter head, each of the grooves having a noticeable color thereon, the colored grooves providing a visual warning of improper placement of said putter head when said putter head is improperly tilted towards the toe or the heel.

9. The two-faced golf putter according to claim 1, wherein only one of the lateral sides has both the sloping chipping face and the putting face.

10. The two-faced golf putter according to claim 1, wherein said sloping chipping face extends obliquely downward from the top of said body towards the putting face, the putting face being substantially normal to the bottom sole.

11. The two-faced golf putter according to claim 10, wherein said setup guide comprises a channeled groove formed on the toe of said putter head and a channeled groove formed on the heel of said putter head, each of the grooves being angled away from a respective vertical plane of the toe and the heel, each of the grooves having a noticeable color thereon to provide a visual warning of improper placement of said putter head when said putter head is improperly tilted towards the toe or the heel.

* * * * *